US012024778B2

(12) United States Patent
Jurczakowski et al.

(10) Patent No.: US 12,024,778 B2
(45) Date of Patent: Jul. 2, 2024

(54) MEANS FOR CARRYING OUT ELECTROLESS METAL DEPOSITION WITH ATOMIC SUB-MONOLAYER PRECISION

(71) Applicant: UNIWERSYTET WARSZAWSKI, Warsaw (PL)

(72) Inventors: Rafal Jurczakowski, Brwinow (PL); Piotr Polczynski, Grodzisk Mazowiecki (PL); Huber Szabat, Warsaw (PL); Aneta Januszewska, Warsaw (PL); Adam Lewera, Warsaw (PL)

(73) Assignee: UNIWERSYSTET WARSZAWSKI, Warsawa (PL)

( * ) Notice: Subject to any disclaimer, the term of this patent is extended or adjusted under 35 U.S.C. 154(b) by 0 days.

(21) Appl. No.: 16/064,140

(22) PCT Filed: Dec. 23, 2015

(86) PCT No.: PCT/IB2015/059969
§ 371 (c)(1),
(2) Date: Jun. 20, 2018

(87) PCT Pub. No.: WO2017/109556
PCT Pub. Date: Jun. 29, 2017

(65) Prior Publication Data

US 2019/0010609 A1 Jan. 10, 2019

(51) Int. Cl.

| | |
|---|---|
| ***C23C 18/44*** | (2006.01) |
| ***C23C 18/34*** | (2006.01) |
| ***C23C 18/40*** | (2006.01) |
| ***C23C 18/42*** | (2006.01) |

(52) U.S. Cl.
CPC ..... *C23C 18/44* (2013.01); *C23C 18/34* (2013.01); *C23C 18/40* (2013.01); *C23C 18/42* (2013.01)

(58) Field of Classification Search
CPC ..... C23C 18/44; C23C 18/34; C23C 18/40; C23C 18/42
See application file for complete search history.

(56) References Cited

U.S. PATENT DOCUMENTS 3,105,772 A * 10/1963 Loiseleur ..... C23C 18/28 428/434
4,248,633 A 2/1981 Heijnen et al.

FOREIGN PATENT DOCUMENTS

EP 1876261 A1 1/2008
WO WO-2013186740 A1 * 12/2013 ..... B22F 1/0018

OTHER PUBLICATIONS

Hu, et al "Novel plating solution for electroless deposition of gold film onto glass surface", Surface & Coatings Technology 202 (2008), pp. 2922-2926. (Year: 2008).*

(Continued)

*Primary Examiner* — Katherine A Bareford
(74) *Attorney, Agent, or Firm* — BROWDY AND NEIMARK, PLLC

(57) ABSTRACT

The present invention relates to a method of deposition of thin metal layers on different substrates by electroless chemical method. In the method of the invention, the potential of the plating solution, i.e. a solution from which the metal deposition is carried out, is controlled with a redox buffer. The appropriate plating solution is also disclosed.

12 Claims, 7 Drawing Sheets

(56) References Cited

OTHER PUBLICATIONS

Panda, et al "Synthesis of Au Nanoparticles at "all" pH by H2O2 Reduction of HAuCl4", Journal of Nanoscience and Nanotechnology, vol. 7, 2007, pp. 1911-1915. (Year: 2007).*
Wang, et al "Versatile Matrix for Constructing Enzyme-Based Biosensors", Applied Materials & Interfaces 2014,6, pp. 17296-17305. (Year: 2014).*
Tang, et al, "Palladium-Gold Alloy Nanowire-Structured Interface for Hydrogen Sensing", ChemPlusChem, 2015, 80, pp. 722-730 (published online on Jan. 30, 2015). (Year: 2015).*
Patra S et al.: "Selective deposition Pt on Au nanoparticles using hydrogen presorbed into Au nanoparticles during NaBH4 treatment", Electrochimica Acta, Elsevier Science Publishers, Barking, GB, pp. 3441-3445, vol. 54, No. 12, (Apr. 2009).
Akinbulu I A et al, "Surface properties of self-assembled monolayer films of tetra-substitutedcobalt, iron and manganese alkylthio phthalocyanine complexes", Electrochimica Acta, Elsevier Science Publishers, Barking, GB, pp. 7085-7093, vol. 55, No. 23 (Sep. 2010).
Brankovic S R et al: Metal monolayer deposition by replacement of metal adlayers on electrode surface, Surface Science, pp. L173-L179, vol. 474, No. 1-3 (Mar. 2001).
Igor Nicic et al., "Underpotential Deposition of Te Monolayers on Au Surfaces from Perchloric Acid Solution Studied by Chronocoulometry and EQCM" Journal of Physical Chemistry Part B: Condensed Matter, Materials, Surfaces, Interfaces & Biophysical, pp. 12247-12252, vol. 106, No. 47 (Oct. 2002).
Aramata A et al., Underpotential deposition of zinc ions on polycrystalline platinum: FTIR and EQCM study Electrochimica Acta, Elsevier Science Publishers, Barking, GB, pp. 761-165, vol. 41, No. 5 (Apr. 1996).
Kibler et al., Tuning Reaction Rates by Lateral Strain in a Palladium Monolayer, Angew. Chem. Int. Ed. 44: 2080-2084 (2005).
Liao et al., Au(111)—Supported Pt Monolayer as the Most Active Electrocatalyst toward Hydrogen Oxidation and Evolution Reactions in Sulfuric Acid, The Journal of Physical Chemistry, J. Phys. Chem. C, 121:19218-19225 (2017).
Herrero et al., Underpotential Deposition at Single Crystal Surfaces of Au, Pt, Ag and Other Materials, Chem. Rev., 101:1897-1930 (2001).
Brankovic et al., Metal monolayer deosition by replacement of metal adlayers on electrode surfaces, Surface Science, 474:L173-L179 (2001).
Kepp, Chemical Causes of Metal Nobleness, ChemPhysChem, 21:360-369 (2020).

* cited by examiner

MEANS FOR CARRYING OUT ELECTROLESS METAL DEPOSITION WITH ATOMIC SUB-MONOLAYER PRECISION

TECHNICAL FIELD

The invention provides a method for electroless metal deposition with atomic sub-monolayer precision and means to carry out method, in particular the plating solution comprising a redox buffer.

BACKGROUND ART

Underpotential deposition (UPD) is a process of formation of a metal layer on a substrate at potentials positive to the reversible Nernst potential of that metal. The deposition is carried out in a solution comprising a precursor of a depositing species, such as cations of the metal undergoing deposition, whereas the substrate is, in general, composed of a different, more noble metal. Examples of extensively studied UPD systems include Pb, Sn, Cd, Ag, on Au, Pb, Sn, Tl, As, Cu on Ag, and Pb, Zn, Cd on Cu [U.S. Pat. No. 5,385,661 A].

UPD results in monolayer or sub-monolayer deposits, i.e. deposits of one atomic layer thickness, which either cover entire substrate surface or cover the substrate surface partially. The formed monolayer is very often referred to as an adlayer. Under certain circumstances, that is when metal-substrate interaction is sufficiently strong, UPD of a second atomic layer is possible [Schmickler W. and Santos E., Interfacial Electrochemistry, Springer-Verlag Berlin Heidelberg 2010, 69]. Moreover, the UPD deposits have well-defined and homogeneous structure [see, for example, Kibler, L. A. et al., Angewandte Chemie International Edition, 2005, 44, 2080-2084; Baldauf, M. and Kolb, D., The Journal of Physical Chemistry, 1996, 100, 11375-11381; Gorzkowski, M. T. and Lewera, A., The Journal of Physical Chemistry C, 2015, 119, 18389-18395; Lu, G.-Q. et al., The Journal of Physical Chemistry B, 1999, 103, 9700-9711; or Shao, M. et al., Langmuir 2006, 22, 10409-10415].

UPD can be employed to form a metal monolayer on a substrate directly. However, it can also be used to form a metal layer of a less noble metal, for example a copper or led monolayer, which subsequently is replaced in the process of galvanic displacement by another, more noble metal, for example platinum. This results in a formation of a monolayer of the second metal [see, for example, publications U.S. Pat. No. 9,005,331 B2, U.S. Pat. No. 9,150,968 B2, US 2007/0264189 A1, US 2010/0099012 A1, and Brankovic, S. et al., Surf. Sci. 2001, 474, L173-L179]. In addition, a saturated underpotentially adsorbed hydrogen layer can be used to control the growth of platinum or platinum alloy monolayer films as it was disclosed in US 2014/0001049 A1.

UPD has also been used to obtain alloy layers, for example, copper-rich alloys on a substrate [U.S. Pat. No. 5,385,661 A] and semiconductor layers [U.S. Pat. No. 5,320,736 A]. Moreover, UPD can be carried out not only from a solution containing a precursor of a depositing species but also from ionic liquids as disclosed in WO2013173007. It has also been used to construct layered nanostructures, such as radially layered nanocables [see for example WO2006019866].

UPD has proven very useful in formation of core-shell structures. Shells in the form of single monolayer deposits are particularity attractive because only the first layer of the foreign metal reproduces the lattice constant of the substrate. Due to a different lattice constant of the specific shell metal, this effect is responsible for a high lateral stress of the deposited monolayer [Kibler, L. et al., supra], which in turn usually translates into much higher catalytic activity [Weissmüller, J. et al., Physical Chemistry Chemical Physics 2011, 13, 2114-2117].

Thin palladium deposits on different noble metals exhibits higher catalytic activity than pure palladium or pure metals themselves [Baldauf, M. and Kolb, D., supra; Gorzkowski, M. T. and Lewera, A., supra]. For example, catalytic decomposing of formic acid was reported to be more efficient with palladium core-shell deposits on platinum electrodes than to pure palladium electrodes [Lu, G.-Q. et al., supra]. Core-shell systems can be also used for oxygen reduction, which is crucial for fuel cell technology. Catalytic properties of thin palladium deposits on different noble metals have previously been studied and it has been shown that thin Pd/Pt deposits are the most active in the oxygen reduction [Shao et al., supra].

Even though the UPD technique has proven very precise, it, in general, requires an electric contact and conductive support in the form of an electrode to ensure potential control of the system. This approach is particularly inconvenient when the electroreduction has to be performed at a larger scale or when the substrate for UPD deposition is in the form of nanoparticles (NPs). Also the use of non-noble metals as UPD deposited layer and their subsequent displacement with more noble metals is disadvantageous, as it requires exchange of the plating solution and may lead to contamination of the obtained layered system with undesired non-noble metals.

An example of an electroless thin layer metal deposition method was disclosed in U.S. Pat. No. 7,507,495 B2. The method described therein involves contacting hydrogen-absorbed palladium or palladium-alloy particles with a metal salt or metal salt mixture, which results in formation of a sub-monoatomic or monoatomic metal coating on the surface of said particles. However, this method is limited to palladium or palladium alloy substrate. Moreover, it requires particle pretreatment ensuring hydrogen absorption in the particles. The technical solution described therein has several drawbacks. In case of noble metals deposition, the difference in redox potential between hydrogen and metal precursor is very high, which leads to very fast kinetics and results in irregularly deposited layer. Bakos et al. have shown that smooth and thin platinum deposits covering up to 70% of the substrate can be obtained only in a very narrow potential range (30 mV) at the onset of the deposition potential [Bakos I., et al., J Solid State Electrochem (2011) 15:2453-2459]. The quantity of deposited layer cannot be higher than that equivalent to total amount of hydrogen stored at atmospheric pressure (x in $PdH_x$ is approximately 0.6). Moreover, U.S. Pat. No. 7,507,495 B2 does not mention how to prepare subatomic layer with different coverage of a foreign metal. Hydrogen desorbs rapidly from palladium particles when there is no hydrogen partial pressure (deposition conditions). Moreover, the absorbed hydrogen can easily reacts with oxygen.

Therefore, there still exists a need for means to carry out an effective and precise electroless method of controlled deposition of metal monolayers or sub-monolayers on different substrates. There is also a need for a method allowing for deposition of ultra-thin metal deposits (in the orders of few monolayers) with high precision.

DISCLOSURE OF INVENTION

The present invention relates to an effective and accurate electroless method of deposition of ultrathin metal layers on different substrates. In the method of the invention, the potential of the plating solution, i.e. a solution from which metal deposition is carried out, is precisely controlled with a redox buffer. The idea underling the present invention is that the use of the redox buffer to control the potential of the plating solution eliminates the necessity to use any electrochemical methods widely used for UPD in the prior art.

The invention provides a method of electroless deposition of a metal monolayer or sub-monolayer or several monolayers onto a substrate from a plating solution, wherein the deposition process is controlled by means of a redox buffer having comparable concentration of oxidized and reduced form of a redox pair, which is used to adjust the potential of the plating solution and wherein such adjustment of the potential results in deposition of a metal monolayer or sub-monolayer or several metal monolayers onto the substrate, which is immersed into said plating solution.

The metal monolayer is a single layer of metal atoms deposited on the substrate surface, which covers entirely the surface of the substrate. The metal sub-monolayer is a single layer of metal atoms deposited on the substrate surface, wherein the surface substrate is covered only partially. The deposit comprising several monolayers is also referred to as a multilayer deposit. The multilayer deposit can comprise two or more metal monolayers or sub-monolayers. Preferably, a number of metal monolayers or sub-monolayers in the multilayer deposit is in the range of 2-10, and, for example, amounts to 2, 3, 4, 5, 6, 7, 8, 9 or 10. The plating solution, is a solution in which the deposition process takes place, whose potential is precisely adjusted to the onset of the metal precursor deposition onto the surface of the substrate. In one of the embodiments the potential of the plating solution enables the UPD of a metal monolayer or sub-monolayer. Alternatively when the deposition is carried out onto a substrate on which the underpotential deposition is not possible or when a multilayer deposit is required, the potential of the plating solution can be set to a value slightly higher than the onset potential of the overpotential deposition (OPD). Under such conditions the kinetics of deposition process is slow enough that the amount of the deposited metal can controlled with sub-monolayer precision by time of the deposition.

In the preferred embodiment of the method of the invention, the adjustment of the plating solution potential by means of a redox buffer is carried out in the presence of a depositing metal precursor, and the plating solution potential adjustment results in deposition of the metal monolayer or sub-monolayer onto the substrate. It means that the plating solution comprises a predetermined amount of the depositing metal precursors and the metal deposition is entirely controlled change of the potential of the solution.

Alternatively, the adjustment of the plating solution potential by means of a redox buffer in the method of the invention is followed by addition of a depositing metal precursor into said plating solution, and the deposition of a metal monolayer or sub-monolayer is controlled by concentration of said depositing metal precursor. It means that the metal deposition is triggered by addition of the depositing metal precursor, wherein said precursor is added to the plating solution, whose potential has been already adjusted to facilitate the metal deposition (for example UPD deposition).

In the method of the invention the substrate onto which the metal monolayer or sub-monolayer is to be deposited can be immersed into the plating solution at any stage of the plating solution potential adjustment or addition of the depositing metal precursor. Therefore, in the method of the invention adjustment of the plating solution potential is carried out before or after the substrate is immersed into said plating solution. Moreover, the addition of the depositing metal precursor can be carried out before or after the substrate is immersed into said plating solution.

In the preferred embodiment the method of the invention is carried out in an aqueous solution. However, other solvent are also taken into consideration.

For deposition of metals on nanoparticles of other metal in the form of a colloid suspended in a solvent, the redox buffer is added to said colloid and to the plating solution containing depositing metal precursor. The potential of both the plating solution and the colloid is adjusted to a desired value and next both are mixed to allow deposition of the metal on the nanoparticles, which results in core-shell nanoparticles formation. Since the deposition according to the invention is slow (in the order of 1 monolayer per hour) the process can be stopped at any stage, for example by centrifugation.

In the method of the invention the potential of the plating solution is controlled with the redox buffer, that is a buffer comprising a redox pair whose oxidized (ox) and reduced (red) form concentration are comparable (i.e. log([ox]/[red])=±2). Examples of such redox pairs can include: $H_2O_2/O_2$, $Fe(CN)_6^{3-}/Fe(CN)_6^{4-}$, $Fe^{3+}/Fe^{2+}$, $[Co(bipy)_3]^{2+}/[Co(bipy)_3]^{3+}$, $Co(phen)_3^{3+}/Co(phen)_3^{2+}$, $[Ru(bipy)_3]^{3+}/[Ru(bipy)_3]^{2+}$, $[Ru(NH_3)_6]^{3+}/[Ru(NH_3)_6]^{2+}$ $[Ru(CN)_6]^{3-}/[Ru(CN)_6]^{4-}$, $Fe(phen)_3^{3+}/Fe(phen)_3^{2+}$ and $Ce^{4+}/Ce^{3+}$. In any biomedical applications the use of a redox buffer comprising nicotinamide adenine dinucleotide (NADH—reduced form, NAD+—oxidized form) is preferred. The concentration of this buffer is much higher than the concentration of the deposited metal.

In the preferred embodiment the method of the invention involves a proton exchange in the redox reaction, so that the potential is pH dependent. Thus the adjustment of the plating solution potential is carried out by adjustment of the pH. An example of a redox buffer whose potential can be adjusted by pH change is hydrogen peroxide ($H_2O_2$). The electroless deposition of metals in the presence of hydrogen peroxide has not been previously disclosed. The process can be described with the following equation:

$$aM^{n+}+bH_2O_2 \rightarrow cO_2+dM+eH^+$$

When $H_2O_2$ is used in excess, the potential of the plating solution is constant and it is not affected by oxidation of hydrogen peroxide into gaseous oxygen. The preferred concertation of hydrogen peroxide in the plating solution amounts to 1.5 M.

The use of hydrogen peroxide as the redox buffer is also convenient because the potential of the plating solution is controlled by pH of the solution. When the exact potential value necessary for deposition of a metal monolayer, sub-monolayer or multilayer deposit on a substrate is determined, the pH of the plating solution can be calculated and adjusted accordingly. For example, pH of the plating solution can be adjusted to facilitate underpotential deposition of a metal monolayer or sub-monolayer. Therefore, in the most preferred embodiment the plating solution in addition to hydrogen peroxide also comprises means to control pH of the plating solution. Preferably, in the method of the invention a pH buffer solution is added to the plating solution. Many pH buffer solutions are known in the prior art. Most preferably, the pH buffer used in the method of the invention is selected from a group comprising phosphate buffer, acetic buffer and citric buffer.

In order to obtain the desired metal monolayer or sub-monolayer, the plating solution used in the method of the invention needs to include an appropriate depositing metal precursor, such as a metal ion. The depositing metal precursor is a substance, which undergoes reduction at the substrate surface. In the preferred embodiment the depositing metal precursor in the plating solution is selected from a group comprising $Ag^{+1}$, $Cu^{2+}$, $Ptcl_6^{2-}$, $Pt^{2+}$, $PtCl_4^{2-}$, $[Pt(OH)_6]^{2-}$, $[Pt(NH_3)_4]^{2+}$, $PtBr_6^{2-}$, $PdCl_6^{2-}$, $Pd^{2+}$, $PdCl_4^{2-}$, $[Pd(OH)_6]^{2-}$, $[Pd(NH_3)_4]^{2+}$, $PdBr_6^{2-}$, $AuCl_4$, $Au^{3+}$, $Au_+$, $[Au(CN)_2]^-$, $Co^{2+}$, $[Co(NH_3)_6]^{3-}$, $[CoCl(NH_3)_5]^{2+}$, $[CO(NO_2)(NH_3)_5]^{2+}$, $Ni^{2+}$, $Fe^{2+}$, $Fe^{3+}$, $Ru^{2+}$, $Ru^{3+}$, $[Ru(NH_3)_5(N_2)]^{2+}$, $Os^+$, $Os^{2+}$, $Os^{3+}$, $Os^{4+}$, $Os^{5+}$, $Os^{6+}$, $Os^{7+}$, $Ir^{6+}$, $Ir^{3+}$, $Ir^{4+}$, $Ir^{5+}$, $[IrCl_6]^3$, $[IrCl_6]^{2-}$, $[Ir(NH_3)_4Cl_2]^-$, $Rh^{3+}$, $Rh^{4+}$, $[Rh(NH_3)_5Cl]^{2+}$, $RhCl^{3+}$, and $[Rh(CO)_2Cl_2]^-$. The appropriate depositing metal precursor can be provided by dissolving a corresponding metal salt or a hydrate. A suitable metal salt can be selected from a group comprising $AgNO_3$, $AgClO_4$, $AgHSO_4$, $Ag_2SO_4$, AgF, $AgBF_4$, $AgPF_6$, $CH_3COOAg$, $AgCF_3SO_3$, $CuCl_2$, $Cu(NO_3)_2$, $CuSO_4$, $Cu(HSO_4)_2$, $Cu(ClO_4)_2$, $CuF_2$, $(CHCOO)_2Cu$, $H_2PtCl_6$, $H_6Cl_2N_2Pt$, $PtCl_2$, $PtBr_2$, $K_2[PtCl_4]$, $Na_2[PtCl_4]$, $Li_2[PtCl_4]$, $H_2Pt(OH)_6$, $Pt(NO_3)_2$, $[Pt(NH_3)_4]Cl_2$, $[Pt(NH_3)_4](HCO_3)_2$, $[Pt(NH_3)_4](OAC)_2$, $(NH_4)_2PtBr_6$, $K_2PtO_6$, $PtSO_4$, $Pt(HSO_4)_2$, $Pt(ClO_4)_2$, $H_2PdCl_6$, $H_6Cl_2N_2Pd$, $PdCl_2$, $PdBr_2$, $K_2[PdCl_4]$, $Na_2[PdCl_4]$, $Li_2[PdCl_4]$, $H_2Pd(OH)_6$, $Pd(NO_3)_2$, $[Pd(NH_3)_4]Cl_2$, $[Pd(NH_3)_4](HCO_3)_2$, $[Pd(NH_3)_4](OAc)_2$, $(NH_4)_2PdBr_6$, $(NH_3)_2PdCl_6$, $PdSO_4$, $Pd(HSO_4)_2$, $Pd(ClO_4)_2$, $HAuCl_4$, $AuCl_3$, AuCl, $AuF_3$, $(CH_3)_2SAuCl$, AuF, $AuCl(SC_4H_8)$, AuBr, $AuBr_3$, $Na_3Au(S_2O_3)_2$, $HAuBr_4$, $K[Au(CN)_2]$, $CoF_2$, $Co(NO_3)_2$, $CoCl_2$, $CoSO_4$, $Co(HSO_4)_2$, $Co(ClO_4)_2$, $(CHCOO)_2Co$, $CoBr_2$, $[Co(NH_3)_6]Cl_3$, $[CoCl(NH_3)_5]Cl_2$, $[Co(NO_2)(NH_3)_5]Cl_2$, $NiF_2$, $Ni(NO_3)_2$, $NiCl_2$, $NiSO_4$, $Ni(HSO_4)_2$, $Ni(ClO_4)_2$, $(CHCOO)_2Ni$, $NiBr_2$, $Ni(OH)HSO_4$, Ni(OH)Cl, $FeF_2$, $Fe(NO_3)_2$, $FeCl_2$, $FeSO_4$, $Fe(HSO_4)_2$, $Fe(ClO_4)_2$, $(CHCOO)_2Fe$, $FeBr_2$, $FeF_3$, $Fe(NO_3)_3$, $FeCl_3$, $Fe_2(SO_4)_3$, $Fe(HSO_4)_3$, $Fe(ClO_4)_3$, $(CHCOO)_3Fe$, $FeBr_3$, $RuCl_2((CH3)_2SO)_4$, $RuCl_3$, $[Ru(NH_3)_5(N_2)]Cl_2$, $Ru(NO_3)_3$, $RuBr_3$, $RuF_3$, $Ru(ClO_4)_3$, OsI, $OSI_2$, $OsBr_3$, $OsCl_4$, $OsF_5$, $OsF_6$, $OsOF_5$, $OsF_7$, $IrF_6$, $IrCl_3$, $IrF_4$, $IrF_5$, $Ir(ClO_4)_3$, $K_3[IrCl_6]$, $K_2[IrCl_6]$, $Na_3[IrCl_6]$, $Na_2[IrCl_6]$, $Li_3[IrCl_6]$, $Li_2[IrCl_6]$, $[Ir(NH_3)_4Cl_2]Cl$, $RhF_3$, $RhF_4$, $RhCl_3$, $[Rh(NH_3)_5Cl]Cl_2$, $RhCl[P(C_6H_5)_3]_3$, $K[Rh(CO)_2Cl_2]$, $Na[Rh(CO)_2Cl_2]Li[Rh(CO)_2Cl_2]$, $Rh_2(SO_4)_3$, $Rh(HSO_4)_3$ and $Rh(ClO_4)_3$. In the preferred embodiment $Li_2PdCl_4$, $K_2[PtCl_4]$ and $AgSO_4$ can be used as a source of the depositing metal precursor.

As the method of the invention is an electroless deposition method, a metal monolayer or sub-monolayer can be deposited on any substrate. However, in the preferred embodiment of the method of the invention the substrate is selected from a group comprising platinum, palladium, gold, silver, ruthenium, osmium, iridium, rhodium, nickel, cobalt, copper and iron. In the most preferred embodiment the method of the invention is used to obtain a palladium monolayer or sub-monolayer on a platinum substrate, silver monolayer or sub-monolayer on a palladium substrate, a platinum monolayer or sub-monolayer on gold substrate, or palladium monolayer or sub-monolayer on gold substrate. Alternatively a metal monolayer or sub-monolayer can be deposited on a non-metal substrate, such as porous silicon.

Due to their interesting properties and wide application, the nanostructured materials are contemplated as a preferred substrate for a metal monolayer or sub-monolayer deposition in accordance with the present invention. Nanostructured materials and methods of their manufacture are known in the art. Moreover, they can be also obtained from commercial sources (for example from Sigma-Aldrich). Therefore, in the preferred embodiment in the method of the invention, the substrate is in a form of nanostructures is used. Most preferably, the substrate used in the method of the invention is in a form of nanoparticles having diameter from 2 nm to 20 nm and as a result of the method of the invention the core-shell nanoparticles are obtained.

The electroless deposition method of the invention can be carried out more than once. As a result more than one metal monolayer or sub-monolayer can be deposited on the substrate. Each metal monolayer or sub-monolayer can be the same or different. The type of the deposited monolayers or sub-monolayers depends on the depositing metal precursor present in the plating solution, as well as the potential of the plating solution. Therefore, in one of the embodiments, the method of the invention is repeated at least once resulting in a deposition of more than one metal monolayer or sub-monolayer of the same or different metal.

The method of the invention is preferably carried in thermostated reaction vessel, for example in the temperature about 20° C. or about 25° C. However, the method of the invention can also be carried out in ambient temperature.

The invention also provided a plating solution for electroless deposition of a metal monolayer or sub-monolayer onto a substrate, which comprises a depositing metal precursor, wherein said plating solution comprises a redox buffer having comparable concentration of oxidized and reduced form of a redox pair, which controls the plating solution potential.

In the preferred embodiment, the plating solution comprises a redox buffer, which is selected from a group comprising the following redox pairs: $H_2O_2/O_2$ (hydrogen peroxide), $Fe(CN)_6^{3-}/Fe(CN)_6^{4-}$, $Fe^{3+}/Fe^{2+}$, $[Co(bipy)_3]^{2+}/[Co(bipy)_3]^{3+}$, $Co(phen)_3^{3+}/Co(phen)_3^{2+}$, $[Ru(bipy)_3]^{3+}/[Ru(bipy)_3]^{2+}$, $[Ru(NH_3)_6]^{3+}/[Ru(NH_3)_6]^{2+}$ $[Ru(CN)_6]^{3-}/[Ru(CN)_6]^{4-}$, $Fe(phen)_3^{3+}/Fe(phen)_3^{2+}$, $Ce^{4+}/Ce^{3+}$ $V^{3+}/V^{2+}$, $VO^{2+}/V^{3+}$, $VO_2^+/VO^{2+}$ and $NADH/NAD^+$.

The redox buffer needs to be present in the plating solution of the invention in excess, so that the process of the metal monolayer or sub-monolayer deposition does not affect the potential of the plating solution. The concentration of the redox buffer in the plating solution is preferably in the range from 1 to 3 M, more preferably in the range from 1.5 to 2.5 M, and most preferably amounts to 1.5 M.

In the most preferred embodiment redox buffer in the plating solution of the invention is hydrogen peroxide. Also preferably hydrogen peroxide is present in the plating solution of the invention in concentration amounting to 1.5 M. Most preferably, the plating solution of the invention in addition to hydrogen peroxide as the redox buffer also comprises means to control pH, such as pH buffer. Useful buffers include phosphate buffer, acetic buffer and citric buffer. The concentration of the pH buffer in the plating solution depends on the pH necessary to carry out metal deposition.

As it was already discussed above, the plating solution of the invention comprises the depositing metal precursor, such as a metal ion. The depositing metal precursor is preferably selected from a group comprising $Ag^{+1}$, $Cu^{2+}$, $PtCl_6^{2-}$, $Pt^{2+}$, $PtCl_4^{2-}$, $[Pt(OH)_6]^{2-}$, $[Pt(NH_3)_4]^{2+}$, $PtBr_6^{2-}$, $PdCl_6^{2-}$, $Pd^{2+}$, $PdCl_4^{2-}$, $[Pd(OH)_6]^{2-}$, $[Pd(NH_3)_4]^{2+}$, $PdBr_6^{2-}$, $AuCl_4$, $Au^{3+}$, $Au^+$, $[Au(CN)_2]^-$, $Co^{2+}$, $[Co(NH_3)_6]^{3-}$, $[COCl(NH_3)_5]^{2+}$, $[CO(NO_2)(NH_3)_5]^{2+}$, $Ni^{2+}$, $Fe^{2+}$, $Fe^{3+}$, $Ru^{2+}$, $Ru^{3+}$, $[Ru(NH_3)_5(N_2)]^{2+}$, $Os^+$, $Os^{2+}$, $Os^{3+}$, $Os^{4+}$, $Os^{5+}$, $Os^{6+}$, $Os^{7+}$, $Ir^{6+}$, $Ir^{3+}$, $Ir^{4+}$, $Ir^{5+}$, $[IrCl_6]^{3-}$, $[IrCl_6]^2$, $[Ir(NH_3)_4Cl_2]^-$, $Rh^{3+}$, $Rh^{4+}$, $[Rh(NH_3)_5Cl]^{2+}$, $RhCl^{3+}$, and $[Rh(CO)_2Cl_2]^-$. The concentration of the depositing metal precursor is also important, as it may determine the amount of metal atoms deposited on the surface of the substrate. The concentration of the depositing metal precursor in the plating solution is preferably in the range from 30 μm to 5 mM, more preferably 50 μm to 2 mM, most preferably it is selected from 50 μm, 70 μm, 100 μm, 200 μm, 400 μm and 2 mM.

The method and plating solution of the invention facilitate electroless deposition of metal monolayers, sub-monolayers and multilayer deposits. Thus the inconvenient process of electroreduction has been eliminated. Moreover, the method of the invention has eliminated the need of galvanic replacement of the less noble metals deposited by UPD.

In case of nanoparticles (NPs) when the deposition is performed in homogeneous suspension of NPs, the NPs surface is covered evenly by foreign metal. Such core-shell NPs cannot be obtained by electrodeposition.

BRIEF DESCRIPTION OF DRAWINGS

The subject of the invention was illustrated in a drawing, in which.

EXAMPLES

Experimental

Figure 1:
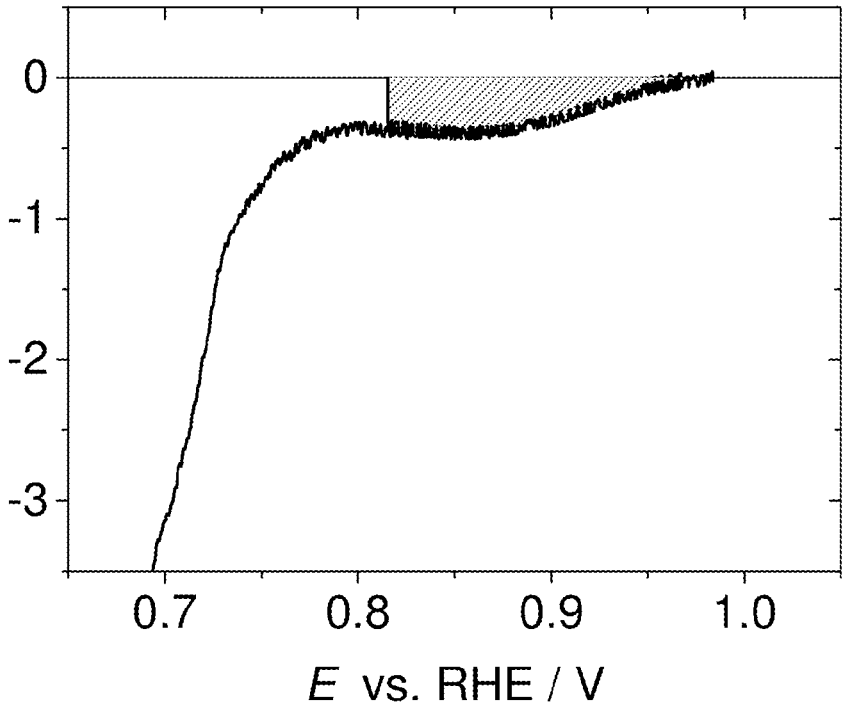
FIG. 1 presents an electrochemical deposition curve of Pd on Pt nanoparticles recorded at scan rate=5 $mV \cdot s^{-1}$ as described in the Reference example.

The following reagents and setups were used in all of the following Examples.

Commercially available sulfuric acid (POCh, 99.99%) was triply distilled by subboiling in a quartz vessel. Stabilizer-free hydrogen peroxide 30% solution (Sigma Aldrich TraceSELECT ultra, 99.999%), 10 mM $[PdCl_4]^{2-}$ complex made of lithium chloride (Puratronic, 99.996%) and palladium chloride powder (Premion, 99.999%), 10 mM $[PtCl_4]^{2-}$ complex and 10 mM $AgSO_4$ (Sigma), were used without further purification.

Before each experiment all solutions were prepared from pure, double distilled and deionized water. All glassware was thoroughly cleaned using "piranha solution", which was made of 30% hydrogen peroxide solution (POCh) and 96% sulfuric acid (POCh, 99.99%) in 1:10 volume ratio, at temperature 80° C. Moreover, all synthesis were carried out in thermostated cell, at temperature 20.0±0.2° C. Platinum and palladium nanoparticle colloids were sonicated before adding to the reaction cell. During synthesis the colloid with reagents were sonicated to prevent nanoparticle aggregation. In order to maintain the pH of depositing solution, a pH buffer was used (0.2 M sodium phosphate di basic (Fluka, >99.99%)/0.2 M phosphate acid (POCh, 99.99%)). Au substrate (Mint of Poland, 99.99+%) was cleaned using "piranha solution".

Electrochemical measurements were performed in a conventional three electrode setup in a glass cell. As electrolyte for these measurements pure 0.5 M $H_2SO_4$ was used. Electrolyte solution was deareated by Ar gas (Air Products, BIP PLUS N6.0) with gas line of corresponding purity.

As a reference electrode a mercury-mercurous sulfate electrode in 0.5 M sulfuric acid was used $Hg/HgSO_4$/0.5 M $H_2SO_4$. The potential of this electrode measured against reversible hydrogen electrode was E=−687 mV. All potentials are referred to this electrode. As a counter electrode a platinum sheet with the surface area A>85 $mm^2$ was used. As a working electrode a gold, circle-shaped electrode was used, which was made of 14 mm gold wire (N5.0 Au). Before any measurements counter electrode was annealed in a hydrogen flame and quenched in deionized water. Before experiments, the purity and surface quality of the working electrode was verified by cyclic votammograms.

After the deposition was completed all nanoparticle samples were centrifuged and rinsed three times with pure water. Then samples (up to 10 μl) were carefully deposited on the working electrode and dried out in an inert atmosphere of Ar gas. When samples became completely dry, working electrode was carefully put into an electrochemical cell.

Au substrates on which monolayers are deposited were used directly as working electrodes. Au substrates surface quality was verified by cyclic voltammogram experiments. After that, Au substrates were added to the reaction cell.

Reference Example. Electrochemically Deposited Pd Layers on Platinum Nanoparticles Thin palladium films were deposited by electrochemical methods as described in by H. Duncan and A. Lasia in "*Mechanism of Hydrogen Adsorption/Ab Sorption at Thin Pd Layers on Au*(111)", Electrochim Acta 2007, 52, 6195-6205, and "*Hydrogen Adsorption/Absorption on Pd/Pt*(111) *Multilayers*", J Electroanal Chem 2008, 621, 62-68. In short, platinum nanoparticles were placed on Au working electrode as described in Experimental section above. The underpotential monolayer of Pd was deposited on Pt nanoparticles from the plating solution comprising 0.1 M $H_2SO_4$ and 1 mM $Li_2PdCl_4$ by scanning the electrode from open circuit to cathodic potentials at 0.1 $mVs^{-1}$. The experiment was stopped, when total charge equals the charge of palladium monolayer, 480 $mQ \cdot cm^2$.

FIG. 1 shows a deposition curve at which a cathodic peak is formed due to palladium underpotential deposition at Pt surface. Similar features has been reported for Pd deposition at Pt(111) monocrystals [see Duncan, H. and Lasia, A., 2008, supra]. The hatched area corresponds to a charge necessary to obtain one Pd monolayer.

Figure 2:
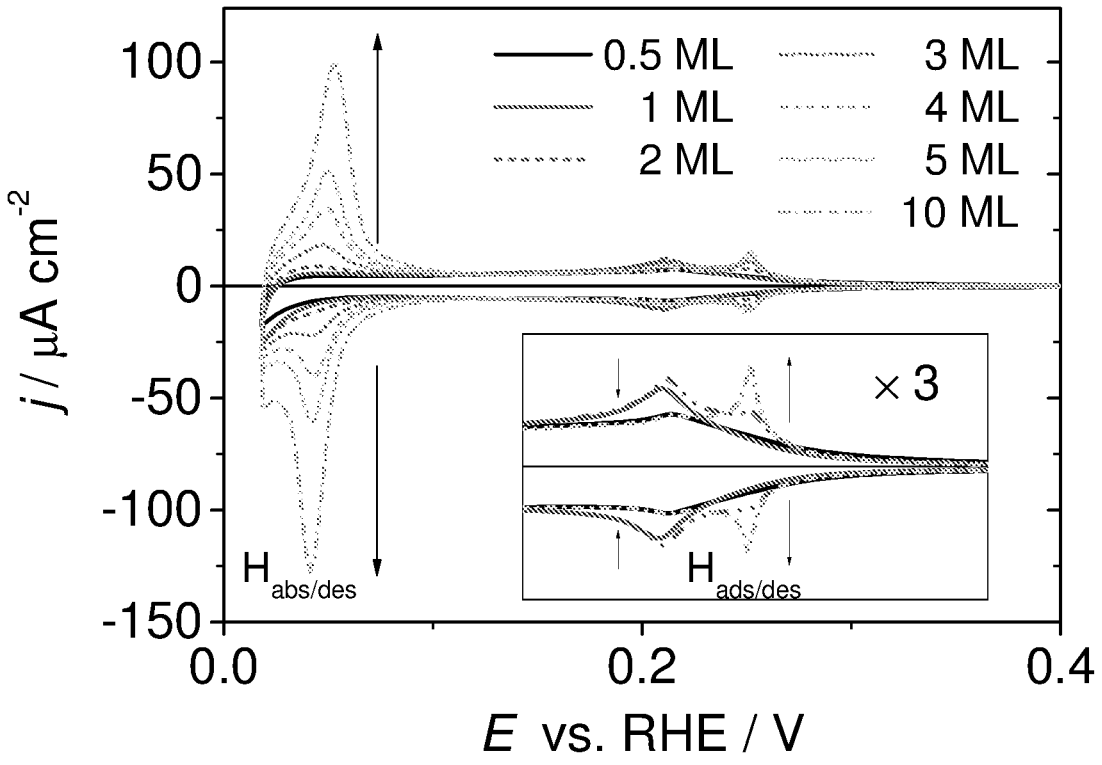
FIG. 2 presents cyclic voltammograms that were recorded at scan rate of 0.1 $mV \cdot s^{-1}$ in 0.1 M $H_2SO_4$ for different numbers of Pd monolayers (ML) deposited on Pt nanoparticles as described in the Reference example.

The electrochemically obtained monolayers were subsequently investigated by cyclic voltammetry in pure 0.1 M $H_2SO_4$. Cyclic voltammograms recorded in this solution for thin layers of palladium deposited on platinum nanoparticles at scan rate of 5 $mV \cdot s^{-1}$ are shown in FIG. 2. "ML" in FIG. 2 indicates a number of Pd monolayers deposited on Pt nanoparticles electrochemically.

To date, thin layers of palladium deposited on platinum nanoparticles have not been studied. However, based on previous voltammograms, which were recorded for platinum monocrystals, peaks can be easily assigned. At E=0.210 V there is a cathodic current peak attributed to hydrogen adsorption on the first palladium monolayer, directly adjacent to the platinum surface. For subsequent monolayers (two and more) the formation of another current peak can be observed at higher potential E=0.250 V. It should be pointed out that the first monolayer is not fully covered by subsequent layers until tenth monolayer is deposited [Duncan, H. and Lasia, A., 2008, supra]. The peak at E=0.210 V decreases and the peak at E=0.250 V increases when coverage of Pd monolayers increases. However, for 10 monolayers, the peak at E=0.250 V almost entirely disappears, which is in agreement with previous data. Furthermore, for the second and subsequent layers there is a cathodic current peak at E=0.042 V caused by hydrogen absorption ($H_{abs}$) into the palladium lattice. With increasing numbers of layers this peak is growing rapidly.

Figure 3:
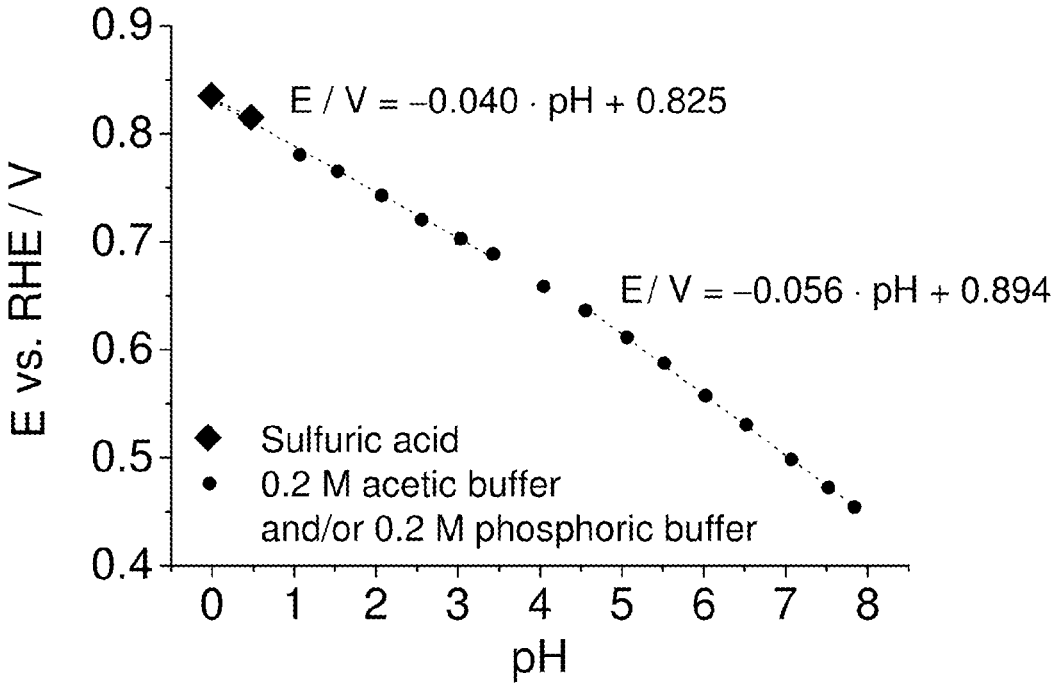
FIG. 3 presents a dependence of the platinum electrode potential on pH of the solution as measured in redox buffer, i.e. 1.5 M $H_2O_2$.

Example 1. Potential Control of the Plating Solution by Means of Redox Buffer The aim of this study was to verify whether it is possible to control potential of the plating solution by means of the redox buffer. For this purpose aqueous solutions of 1.5 M hydrogen peroxide was used. The dependence of platinum electrode potentials in function of solution pH was determined by open circuit measurements. The potential was adjusted by using 0.2 M acetic buffer and/or 0.2 M phosphoric buffer. To maintain pH<1 sulfuric acid was used. The results are shown in the FIG. 3.

The electrode potentials are in linear dependence with pH of the solution with the slope 0.043 and 0.056 mV per decade concentration for pH higher and lower than 4, respectively. Based on the linear fitting of experimental results, the potentials of plating solutions with different pH values can be presented as E/V=−0.040·pH+0.825 for pH lower than 3.5, and E/V=−0.056·pH+0.894 for pH's value higher than 4.5.

Although platinum catalyzes decomposition of hydrogen peroxide, during open circuit measurements the potential values did not change for more than 10 mV in the period of one hour. Thus the measured potential values are practically independent on the concentration of the hydrogen peroxide. The change in the concentration of hydrogen peroxide does not influence the platinum electrode potential, which is in agreement with previous data Ping, X. et al., Journal of Electroanalytical Chemistry 2011, 658, 46-511.

Example 2. Electroless Deposition of Palladium on Platinum Nanoparticles

Palladium deposition in the presence of hydrogen peroxide may be described with the following equation (in appropriate pH):

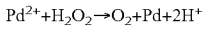

$$Pd^{2+}+H_2O_2 \rightarrow O_2+Pd+2H^+$$

During oxidation of hydrogen peroxide into a gaseous oxygen, the plating solution potential value is constant, because $H_2O_2$ is used in excess.

In all cases the monolayer deposition was carried out in the same way. 1.5 M hydrogen peroxide was used as a redox buffer. When the exact potential value necessary for deposition of a metal monolayer on a substrate is determined, the pH of the plating solution is calculated and adjusted accordingly.

The electroless deposition of Pd on Pt nanoparticles was carried out at different pH values: 0, 1 and 2, as well as for different $PdCl_4^{2-}$ concentrations: 50 μm, 100 μm, 200 μm and 400 μM. In each case the electroless deposition of Pd on Pt nanoparticles was carried out for 2 hours.

Figure 4A:
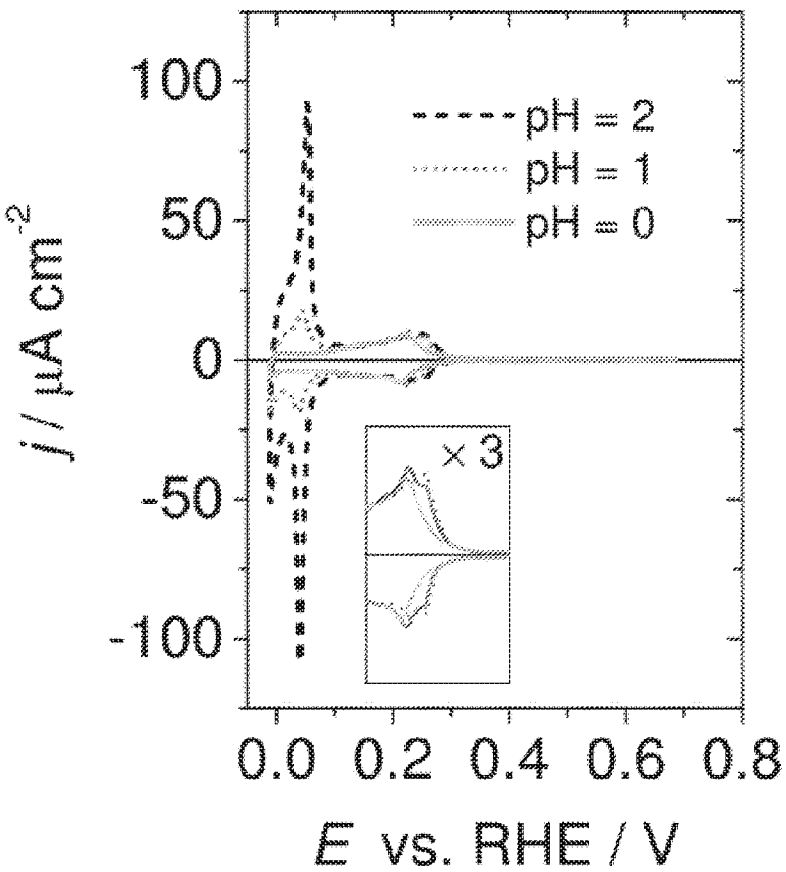
FIG. 4A presents cyclic voltammograms recorded for Pd monolayers deposited on Pt nanoparticles by electroless deposition from plating solutions having different pH.
Figure 4B:
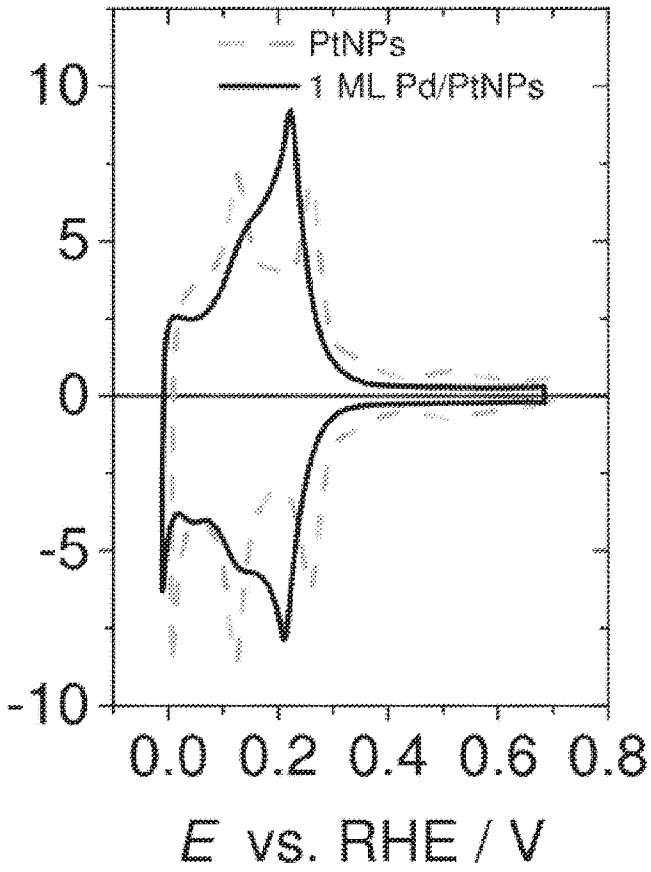
FIG. 4B presents cyclic voltammograms recorded for Pt nanoparticles (PtNPs) without Pd monolayer deposit and for Pt nanoparticles covered with a single layer of Pd.

The core-shell Pt/Pd nanoparticles obtained as described above were subsequently investigated by cyclic voltammetry. FIG. 4A presents cyclic voltammograms recorded at 5 $mVs^{-1}$ for Pd monolayers deposited on Pt nanoparticles by electroless deposition from plating solutions having different pH and the constant $Pd^{2+}$ concentration amounting to 200 μM. FIG. 4B presents cyclic voltammograms recorded for Pt nanoparticles (PtNPs) without Pd monolayer deposit and for Pt nanoparticles covered with a single layer of deposited Pd (1 ML Pd/PtNPs).

For Pd deposits obtained at pH=2 and 1 a cathodic current peak at E=0.042 V can be noticed. It is attributed to hydrogen absorption, which increases when pH value of the plating solution increases. It means that the coverage of palladium monolayer increases, while the potential of the plating solution decreases. For deposits obtained at pH=0 there is no hydrogen absorption, which means that coverage of palladium is less than or equals 1 monolayer. From FIG. 2 it follows that redox potential of the plating solution is equal to 0.83 V. From FIG. 1 it can be observed that at this potential only underpotential deposition is possible. Furthermore, at 0.83 V the Pd surface coverage is 0.8 ML. Below 0.80 V the overpotential Pd deposition starts to occur. Cyclic voltammogram for a single Pd layer deposited by electroless deposition is shown in FIG. 4B. Lack of the hydrogen adsorption current peak at E=0.250 and lack of hydrogen absorption current peak at E=0.042 V indicates that Pd coverage does not exceed a single monolayer.

Shapes of the cyclic voltammetry curves are similar to previously shown for Pd monolayer deposits obtained electrochemically (see FIG. 2).

In conclusion, one palladium monolayer can be deposited under control of the plating solution potential.

Figure 5A:
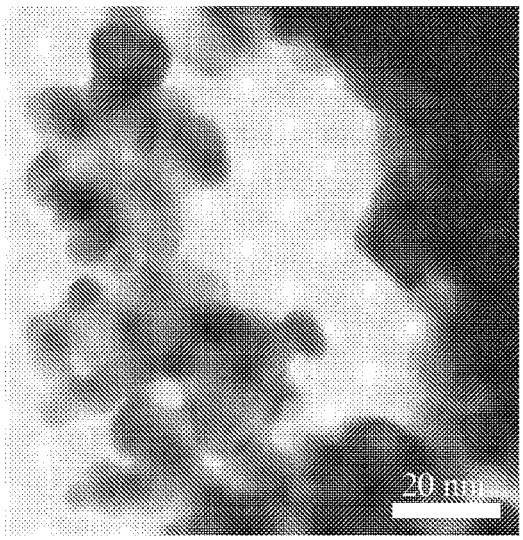
FIGS. 5A and 5B present TEM micrographs of pure Pt nanoparticles (FIG. 5A) and Pt nanoparticles covered with a Pd monolayer (FIG. 5B)
Figure 5B:
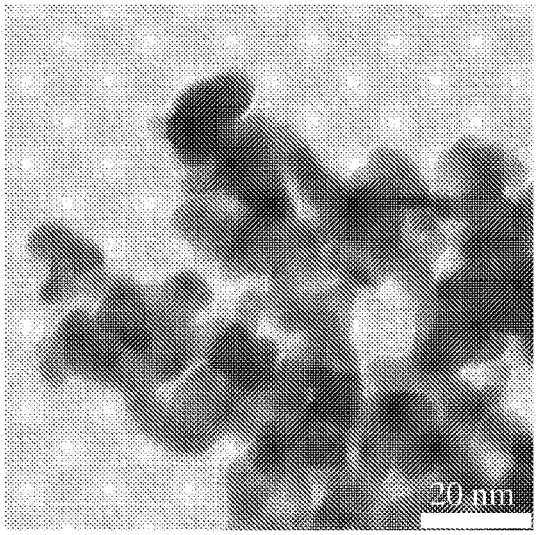

FIGS. 5A and 5B present, respectively, TEM micrographs of bare Pt nanoparticles and Pt nanoparticles covered with Pd monolayer deposited as described above. Even though, the Pd deposit is not seen in the TEM micrographs (the size of the nanoparticles is remains the same after Pd deposition), its electrochemical properties can be clearly observed in cyclic voltammetry experiments. This confirms that the Pd deposit formed corresponds to a single monolayer.

The thickness of the Pd deposit can be also controlled by the concentration of $[PdCl_4]^{2-}$ complex.

Figure 6:
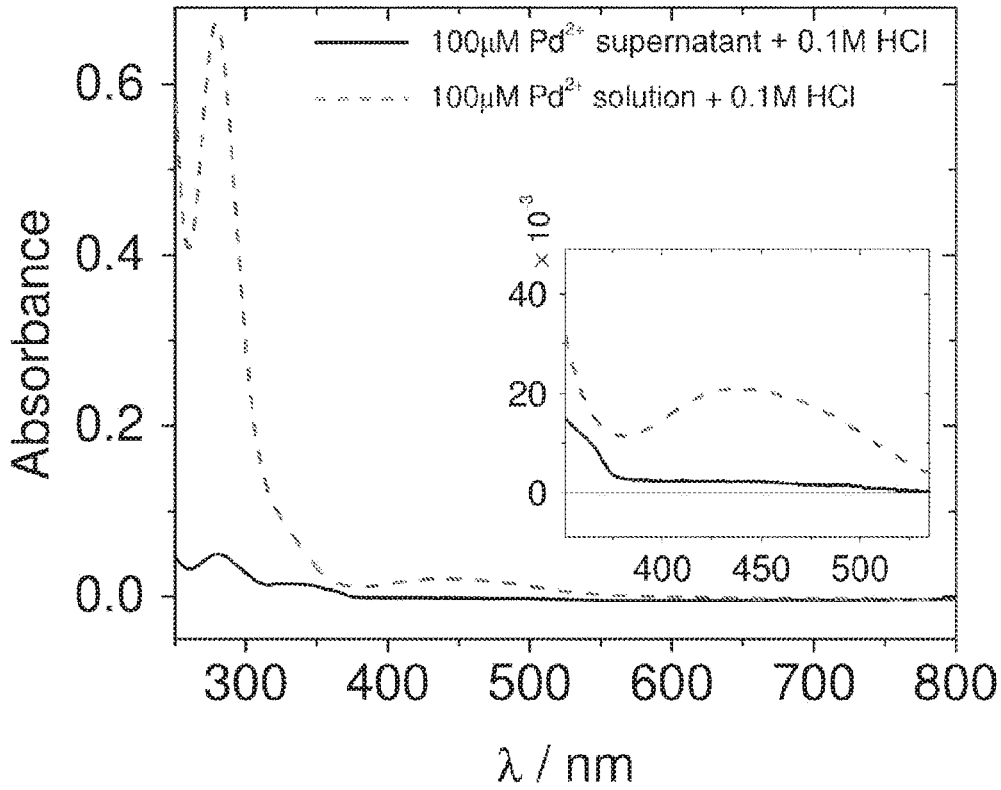
FIG. 6 presents a UV-vis spectrum of a sample from the plating solution used to deposit Pd on Pt nanostructures compared with a spectrum of a corresponding $Pd^{2+}$ solution.

$PdCl_4^{2-}$ was added to the plating solution with suitable pH value (for example pH=1). In order to maintain an exact pH value of the plating solution, a 0.2 M phosphate buffer was used. Concentration of $Pd^{2+}$ ion has to be adjusted to the amount of platinum nanoparticles and number of monolayers to be deposited. After palladium deposition on Pt nanoparticles. The colloids were centrifuged and the samples of the plating solution (supernatants) were collected in order to monitor the $Pd^{2+}$ ion concentration by recording UV-Vis spectra. However, in very low values of palladium(II) ions concentration, $PdCl_4^{2-}$ complex dissociates into different palladium(II) chloro- and aquocomplexes. Hence, the excess of chloride was added to maintain palladium(II) complexes as $PdCl_4^{2-}$ complex, for this purpose HCl was added to supernatants before UV-Vis investigations. An example of such UV-Vis spectrum is presented in FIG. 6, which compares a spectrum recorded for the supernatant obtained after palladium deposition on Pt nanoparticles from plating solution containing initially 100 μM $Pd^{2+}$ (solid line) with a spectrum of 100 μM $Pd^{2+}$ solution with 0.1 M HCl (dashed line). From this spectra it can be seen that virtually all palladium was deposited. From such analysis the thickness of the Pd shells can be estimated.

The concentration of Pd' necessary to deposit a Pd layer of desired thickness can be determined based on the specific surface area of Pt nanoparticles. A cyclic voltammogram of platinum nanoparticles is shown in FIG. 4B (dashed line).

Influence of $Pd^{2+}$ ion concentration on number of monolayers deposited was investigated. The results presented below have shown that the amount of palladium ions in the plating solution can limit the number of Pd monolayers deposited on Pt nanoparticles.

Figure 7:
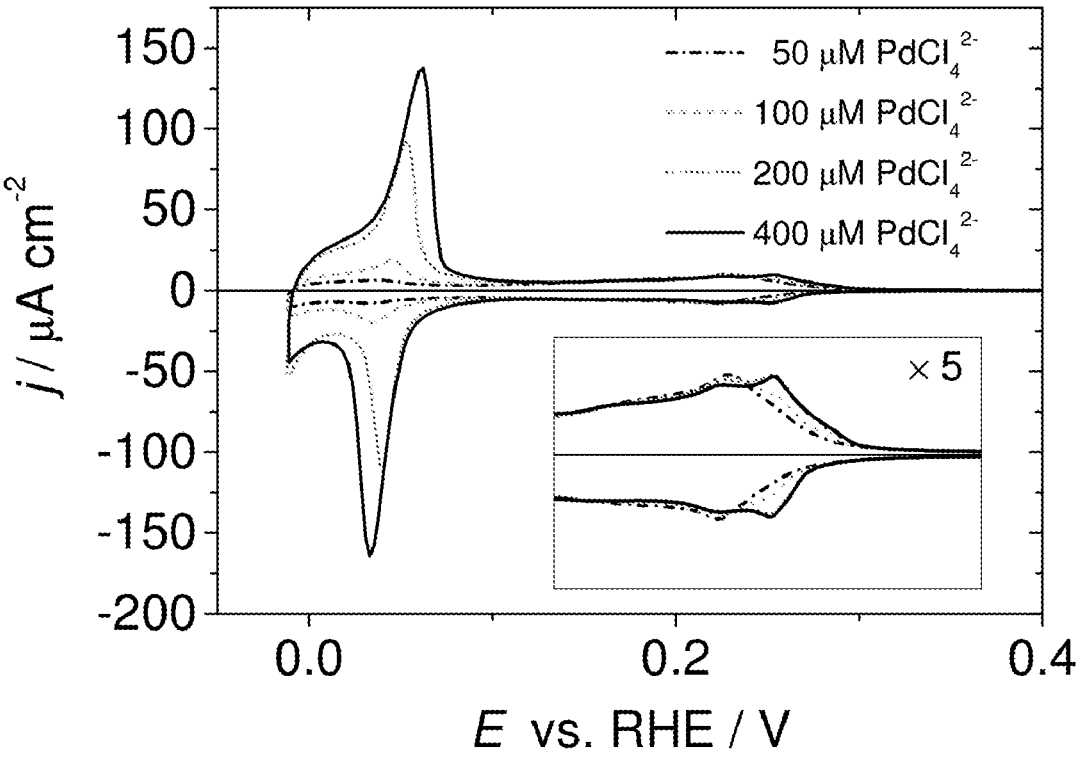
FIG. 7 presents cyclic voltammograms of Pt nanoparticles covered with Pd monolayers deposited from the plating solutions comprising different $Pd^{2+}$ concentrations.

In this examples Pd deposits obtained from four different concentrations of $Pd^{2+}$ in the plating solution were investigated by cyclic voltammetry. The corresponding voltammograms recorded at 5 $mV \cdot s^{-1}$ are presented in FIG. 7.

Shapes of the cyclic voltammetry curves are similar to previously shown in FIG. 4A. The cathodic current peak at E=0.250 V, which is attributed to hydrogen adsorption on 2nd and further monolayers, increases while concentration of Pd2+ in the plating solution increases. Second Hads-peak, at E=0.210 V decreases while concentration of Pd2+ ions in deposition baths increases. It means that the coverage of palladium monolayers increases with increasing concentration Pd2+ ions. For Pd2+ concentration amounting to 50 μM there is a modest hydrogen absorption current peak, which means that coverage of platinum nanoparticles is about one monolayer thick.

Example 3. Electroless Deposition of Silver on Palladium Nanoparticles

Electroless deposition of Ag on Pd nanoparticles was carried out as described above from the plating solution comprising 1.5 M of $H_2O_2$ and 2 mM $Ag^+$ at pH=4 (0.2 M acetic buffer). Deposition was carried out for 4 hours in the controlled temperature of 20° C.

Figure 8:
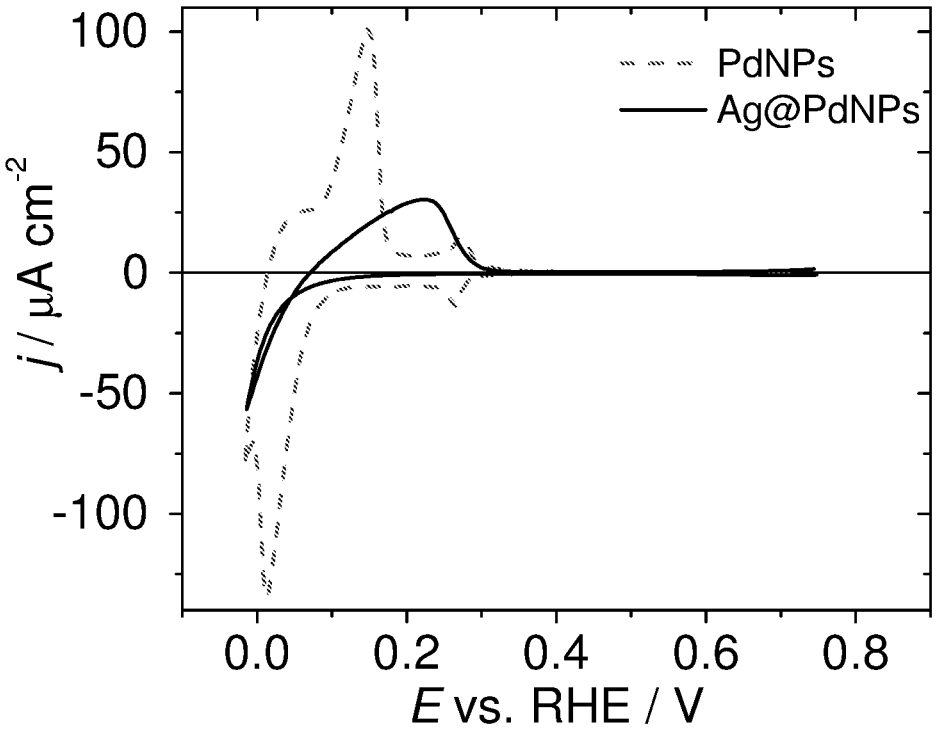
FIG. 8 presents cyclic voltammograms recorded at 5 $mV \cdot s^{-1}$ for pure 10 nm Pd nanoparticles and core-shell nanoparticles Pd/Ag obtained in Example 3.

On FIG. 8 cyclic voltammograms recorded at 5 $mV \cdot s^{-1}$ for pure 10 nm Pd nanoparticles (PdNPs) (dashed line) and core-shell nanoparticles Pd/Ag (Ag@PdNPs) (solid line) are compared. No cathodic current peak at E=0.29, i.e. the peak attributed to hydrogen adsorption, can be observed on the cyclic voltammogram recorded for Pd/Ag core-shell nanoparticles. It means that the surface of Pd nanoparticles is entirely covered by silver atoms. However, this layer is so thin that it is permeable to hydrogen absorption. The later can be deduced from the cathodic current decrease and corresponding anodic current peak at E=0.2 V. A more significant peaks separation is related to slower hydrogen absorption for Pd/Ag core-shell nanoparticles in compaction to uncovered palladium nanoparticles.

Example 4. Electroless Deposition of Platinum on Gold Substrate

Electroless deposition of Pt on gold electrode was carried out as described above from the plating solution comprising 1.5 M of $H_2O_2$ and 200 μM $PtCl_4^{2-}$ at pH=0 (1 M sulfuric acid), pH=1 (0.1 M sulfuric acid) and pH=2 (0.2 M phosphate buffer). Deposition was carried out for 16 hours in the controlled temperature of 20° C.

Figure 9:
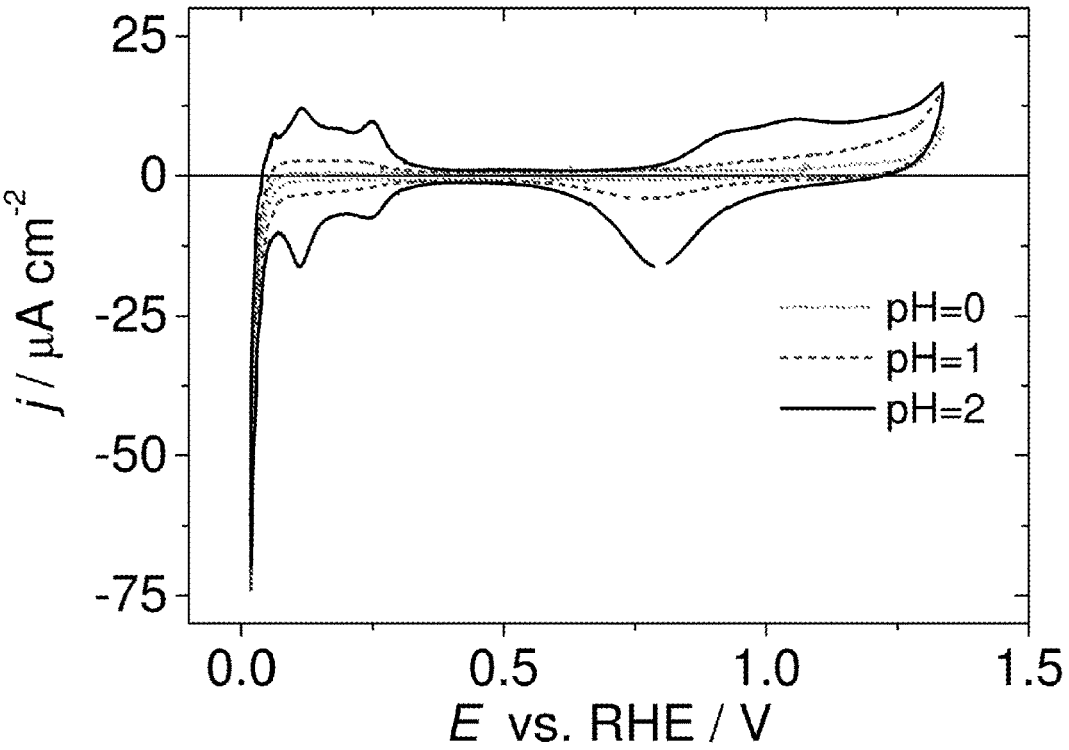
FIG. 9 presents cyclic voltammograms recorded at 5 $mV \cdot s^{-1}$ for Au electrode covered by a different number of Pt monolayers deposited at different pH values.

Cyclic voltammograms were recorded at 5 $mV \cdot s^{-1}$ for Au electrode covered by a different number of Pt monolayers deposited at different pH values (FIG. 9).

Platinum surface coverage can be deduced by the charge of hydrogen adsorption/desorption within the potential range 0.1 to 0.3 V.

Example 5. Electroless Deposition of Palladium on Gold Substrate

Electroless deposition of Pd on gold electrode was carried out as described above from the plating solution comprising 1.5 M of $H_2O_2$ and 70 μm $PdCl_4^{2-}$ at pH≈0 (2 M sulfuric acid). Deposition was carried out for 30 minutes in the controlled temperature of 20° C.

Figure 10:
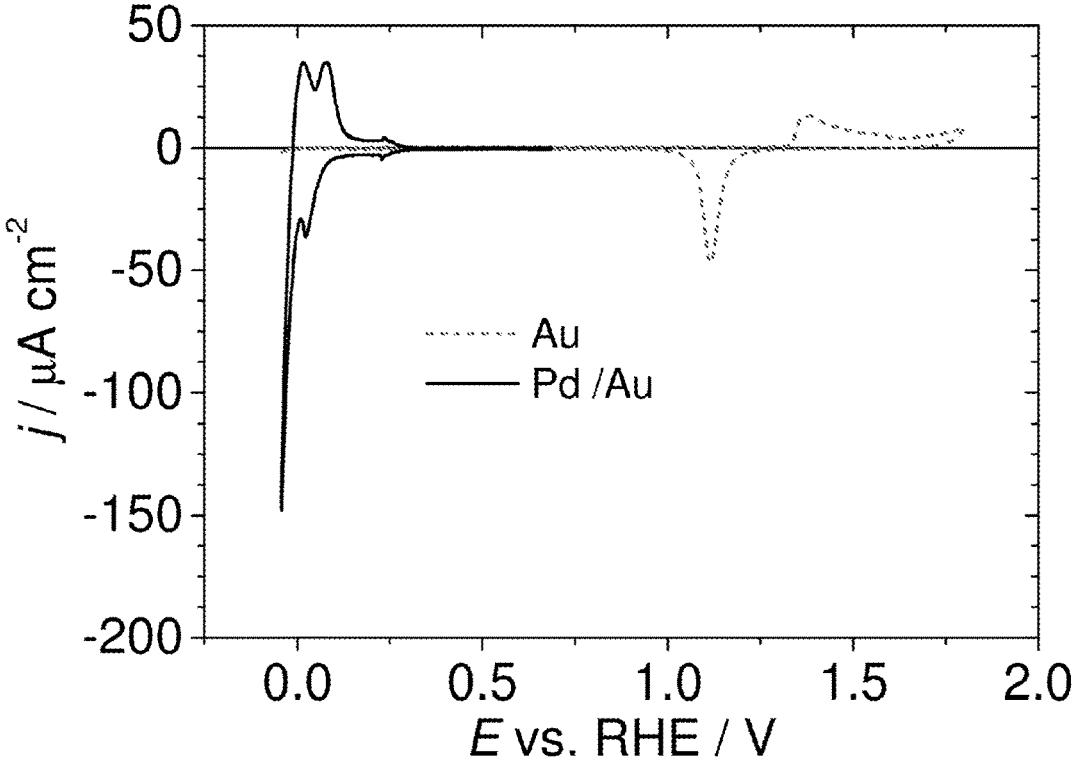
FIG. 10 presents cyclic voltammograms recorded at 5 $mV \cdot s^{-1}$ for Au electrode and Au electrode covered by Pd monolayers.

Cyclic voltammograms were recorded at 5 $mV \cdot s^{-1}$ for Au electrode and Au electrode covered by Pd monolayers (FIG. 10). On the cyclic voltammogram recorded for Au electrode covered by Pd monolayers (solid line), the hydrogen adsorption and absorption current peaks can be observed. From the relative current height the estimated palladium layer thickness is about 1 nm (which corresponds roughly to about 5 monolayers of Pd atoms).

Example 6. Electroless Deposition of Pd on Porous Silicon

Nanoporous silicon was obtained from commercially available p-type Si(100) wafer (ITME, resistivity 1.0-5.0 Ωcm, 600 μm in thickness) according to procedure described in [Oh, J. H., et al., Energy & Environmental Science, 2011. 4(5): p. 1690-1694]. Electroless deposition of Pd on this nanoporous Si substrate was carried out as described above from the plating solution comprising 1.5 M of $H_2O_2$ and 70 μM $PdCl_4^{2-}$ at pH≈1 (0.2 M phosphoric buffer). Deposition was carried out for 30 minutes in the controlled temperature of 25° C.

Figure 11:
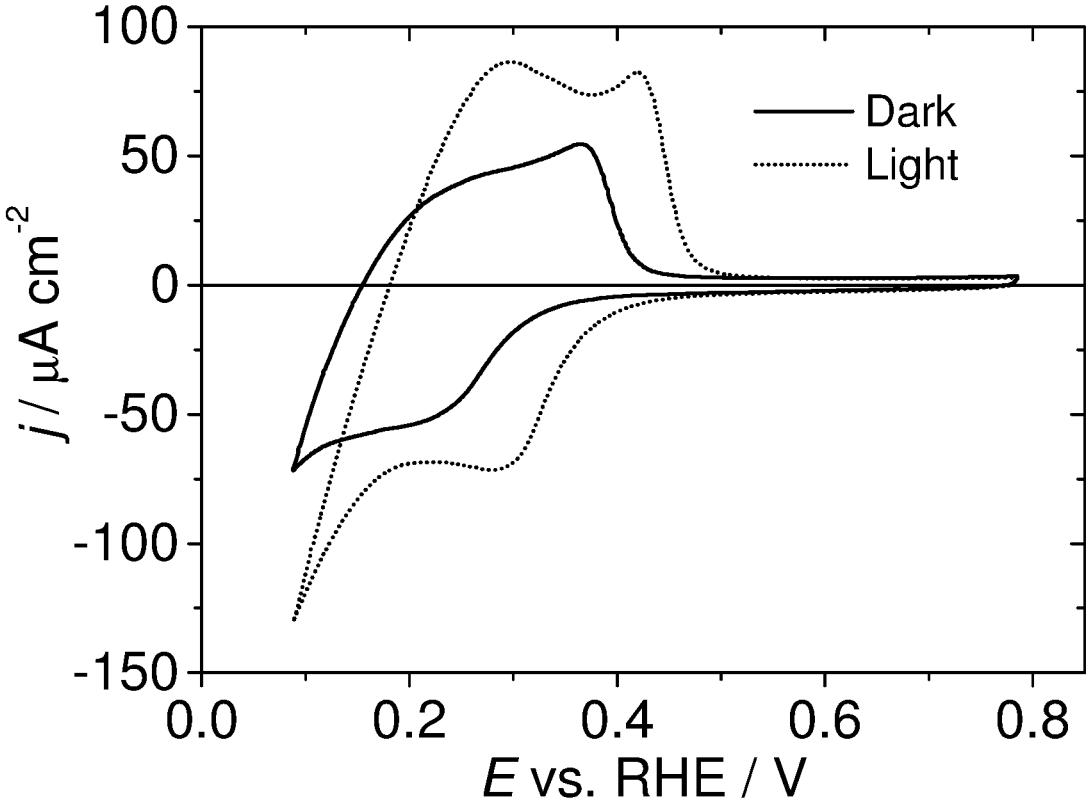
FIG. 11 presents cyclic voltammograms recorded at 10 $mV \cdot s^{-1}$ for nanoporous silicon electrode covered by Pd monolayers in dark (solid line) and under illumination with halogen lamp 100 mW $cm^{-2}$ (dashed line).

Cyclic voltammograms were recorded at 10 $mV \cdot s^{-1}$ for nanoporous Si electrode covered by Pd monolayers (FIG. 11). On the cyclic voltammogram recorded using this electrode (solid line), the hydrogen adsorption/absorption current peaks can be observed. The deposit is of the order of several monolayers and the electrode is sensitive to visible light. After electrode illumination with halogen lamp (100 $mW \cdot cm^{-2}$) the hydrogen absorption/desorption peaks shift toward more positive potentials (FIG. 11 dashed line).

The invention claimed is:

1. A method of electroless deposition of a metal monolayer or sub-monolayer onto a substrate from a plating solution, wherein the deposition process is controlled by means of a redox pair having a pH dependent potential and pH adjustment is used to adjust redox potential of the plating solution to a value at which underpotential deposition (UPD) of a metal monolayer or sub-monolayer occurs onto the substrate, which is immersed into said plating solution, and wherein the deposited metal is selected from a group consisting of silver, copper platinum, palladium, cobalt, nickel, ruthenium, osmium, iridium, and rhodium.

2. The method of claim 1, wherein the adjustment of the plating solution potential by means of pH adjustment is carried out in the presence of a depositing metal precursor, and wherein the plating solution potential adjustment results in deposition of the metal onto the substrate.

3. The method of claim 1, wherein the adjustment of the plating solution potential by means of pH adjustment is followed by addition of a depositing metal precursor into said plating solution, and wherein the deposition of a metal is controlled by concentration of said depositing metal precursor.

4. The method of claim 1, wherein adjustment of the plating solution potential is carried out before or after the substrate is immersed into said plating solution.

5. The method of claim 1, wherein the addition of a depositing metal precursor is carried out before or after the substrate is immersed into said plating solution.

6. The method of claim 1, wherein the plating solution is an aqueous solution.

7. The method of claim 1, wherein the redox pair is selected from a group consisting of $H_2O_2/O_2$ (hydrogen peroxide), $VO^{2+}/V^{3+}$, $VO_2^{+}/VO_2^{+}$ and $NADH/NAD^{+}$.

8. The method of claim 7, wherein the redox pair is $H_2O_2/O_2$.

9. The method of claim 1, wherein a depositing metal precursor in the plating solution is selected from a group consisting of $Ag^{+1}$, $Cu^{2+}$, $PtCl_6^{2-}$, $Pt^{2+}$, $PtCl_4^{2-}$, $[Pt(OH)_6]^{2-}$, $[Pt(NH_3)_4]^{2+}$, $PtBr_6^{2-}$, $PdCl_6^{2-}$, $Pd^{2+}$, $PdCl_4^{2-}$, $[Pd(OH)_6]^{2-}$, $[Pd(NH_3)_4]^{2+}$, $PdBr_6^{2-}$, $Co^{2+}$, $[Co(NH_3)_6]^{3-}$, $[CoCl(NH_3)_5]^{2+}$, $[Co(NO_2)(NH_3)_5]^{2+}$, $Ni^{2+}$, $Ru^{2+}$, $Ru^{3+}$, $[Ru(NH_3)_5(N_2)]^{2+}$, $Os^{+}$, $Os^{2+}$, $Os^{3+}$, $Os^{4+}$, $Os^{5+}$, $Os^{6+}$, $Os^{7+}$, $Ir^{6+}$, $Ir^{3+}$, $Ir^{4+}$, $Ir^{5+}$, $[IrCl_6]^{3-}$, $[IrCl_6]^{2-}$, $[Ir(NH_3)_4Cl_2]^{-}$, $Rh^{3+}$, $Rh^{4+}$, $[Rh(NH_3)_5Cl]^{2+}$, $RhCl^{3+}$, and $[Rh(CO)_2Cl_2]^{-}$.

10. The method of claim 1, wherein the substrate is selected from a group consisting of platinum, palladium, gold, silver, ruthenium, osmium, iridium, rhodium, nickel, cobalt, copper, iron and porous silicon.

11. The method of claim 1, wherein palladium monolayer or sub-monolayer is deposited on platinum substrate, silver monolayer or sub-monolayer is deposited on palladium substrate, platinum monolayer or sub-monolayer is deposited on gold substrate, palladium monolayer or sub-monolayer is deposited on gold substrate, or palladium monolayer or sub-monolayer is deposited on porous silicon substrate.

12. The method of claim 1, wherein said method is repeated at least once resulting in deposition of more than one metal monolayer or sub-monolayer of different metal.

* * * * *